United States Patent [19]

Johansen

[11] Patent Number: 4,982,852

[45] Date of Patent: Jan. 8, 1991

[54] DISPLAY ASSEMBLY

[75] Inventor: Norman A. Johansen, North Ridgeville, Ohio

[73] Assignee: The Sherwin-Williams Company, Cleveland, Ohio

[21] Appl. No.: 291,818

[22] Filed: Dec. 29, 1988

[51] Int. Cl.[5] ..... A47F 5/00

[52] U.S. Cl. ..... 211/162; 211/86; 211/94; 211/175

[58] Field of Search ..... 211/162, 86, 50, 55, 211/175, 59.2, 94

[56] References Cited

U.S. PATENT DOCUMENTS

| | | | |
|---|---|---|---|
| 2,098,828 | 11/1937 | Ludwick | 211/162 X |
| 2,633,810 | 4/1953 | Freeman | 211/162 X |
| 4,003,470 | 1/1977 | Lagorio et al. | 211/50 |
| 4,062,452 | 12/1977 | Bartholomew | 211/55 |
| 4,077,520 | 3/1978 | Stevenson | 211/55 |

*Primary Examiner*—Robert W. Gibson, Jr.
*Attorney, Agent, or Firm*—Robert E. McDonald; Steven W. Tan; Jeanne E. Longmuir

[57] ABSTRACT

A display assembly for sample materials, merchandise or the like, having a shelf sub-assembly with a plurality of shelves defining a storage space and a display space, and display a panel movably supported on the shelf sub-assembly. The display panel includes a surface having compartments for displaying the sample materials, merchandise or the like. Sliding structure is also included for movably supporting the panel on the shelf sub-assembly to selectively cover the work or storage space of the shelf sub-assembly. The sliding structure includes a rail secured to the shelf sub-assembly, and cooperating guide rollers secured to the panel for movable engagement along the rail to selectively access or close the work or storage space of the shelf sub-assembly.

13 Claims, 7 Drawing Sheets

DISPLAY ASSEMBLY

TECHNICAL FIELD

The present invention relates to a display assembly having a movable panel for displaying sample materials, merchandise or the like, and more particularly to a slidable display panel movably mounted along a shelf sub-assembly for selectively covering a portion of the shelf sub-assembly.

BACKGROUND

Retail paint stores typically sell numerous types of paint products and accessories, as well as a variety of other home improvement supplies. To best serve their customers' needs, retail paint stores offer a wide variety of merchandise for customer selection. In order to display a wide variety of merchandise for sale, sufficient display space must be available throughout the store. Unfortunately, display space is also required for a variety of other uses which are unrelated to displaying merchandise for sale and thus do not contribute to increasing sales. As a result, available display space in retail stores is a valuable and limited resource.

In the past, valuable display space has been used for displaying sample materials, such as sample paint color cards in paint stores. Display panels are typically used for displaying such sample materials. The display panels are mounted on the walls of the store, or on mounting board which would otherwise support shelves for displaying merchandise. For ease of customer accessibility, the panels are generally positioned at eye level so that the samples are readily visible and within the customers' reach. When positioned in such visible and accessible locations, the display panels occupy highly valuable space for displaying merchandise for sale to customers.

Additional display space has also been used to provide employee work stations. Work stations are required in retail paint stores for performing tasks such as tinting paint products purchased by customers. In the past, such employee work stations have been located on additional counter space or on display shelves. Since the equipment required for tinting paint must be positioned at eye level and within the grasp of paint store employees operating the equipment, the tinting equipment and work station also occupy desirable display space which would otherwise be available for displaying merchandise for sale. Because space for displaying merchandise is limited and in such demand, it is undesirable to use highly visible and accessible space for purposes unrelated to the sale of merchandise, such as for displaying sample materials or supporting tinting equipment.

SUMMARY OF THE INVENTION

The present invention provides a new and improved display assembly constructed and arranged to display sample materials, merchandise or the like, on a movable display panel movably secured to a shelf sub-assembly for selectively accessing or covering a portion of the shelf sub-assembly.

In accordance with the preferred-embodiment of the invention, the display assembly includes a shelf sub-assembly defining a work or storage space and a merchandise display space, and a display panel movably supported on the shelf sub-assembly. The display panel includes compartments for displaying sample paint color cards, or other brochure materials or merchandise. The panel is movably supported on the shelf sub-assembly by sliding structure for selectively covering either the work space or the display space.

Use of the preferred embodiment of the display assembly of the present invention minimizes the use of valuable display space for uses unrelated to the sale of merchandise, such as a sample display section and an employee work station. The present invention combines two prior uses of valuable display space, into a single space use for non-sales related activities. The use of single space for dual activities is accomplished by locating the work station on the shelf sub-assembly and movably supporting the display panel on the shelf sub-assembly selectively covering the work space.

In the preferred embodiment of the present invention, the shelf sub-assembly includes a base having a mounting board or peg-board secured to the base, and a plurality of shelves selectively secured to the mounting board by support brackets to define the work space and display space. The shelf sub-assembly may be of any number of conventional shelf designs, including those having single width shelves, or decreasing width or stepped shelves.

One portion of the shelf sub-assembly includes the work or storage space defined by spaced shelves secured to the mounting board. The shelves are sufficiently spaced to accommodate tinting equipment, in the case of a work space, or additional inventory in the case of a storage space. A portion of the shelf sub-assembly adjacent the work space includes the display space. The display space is defined by spaced shelves secured to the mounting board, and positioned on the mounting board to display the merchandise supported thereon.

In the preferred embodiment, the display panel movably supported on the shelf sub-assembly includes a display surface with compartments for supporting and displaying the sample paint color cards, or other merchandise. Each of the compartments forms an individual container for vertically supporting the discrete sample paint color cards. The compartments of the display panel may be provided by any number of conventional designs, for example, the display panel and compartments may be formed as a single module unit of molder plastic, or the compartments may be formed individually or in groups, and separately secured to the display panel.

The display panel is preferably of a size adapted selectively to cover the work space defined by the shelf sub-assembly, and to support the desired quantity of sample paint color cards. Additional smaller display panels may, however, be added as necessary to a top or bottom edge of the display panel to display additional sample paint color cards.

The sliding structure of the present invention movably supports the display panel on the shelf sub-assembly. In the preferred embodiment, the sliding structure is secured in part to the display panel and in part to the shelf sub-assembly to movably support the panel on the sub-assembly. The sliding structure comprises an upper rail, a cooperating guide roller assembly and a lower adjustable roller assembly. The upper rail is an elongate member preferably secured to the shelf sub-assembly along horizontally aligned shelves of the adjacent shelf portions in the work space and display space areas. The rail is positioned on the aligned shelves approximately at or above eye level. In the preferred embodiment the rail extends along the adjacent shelf portions having the work and display spaces, and is thus adapted to enable movement of the display panel between positions covering and uncovering the work space.

The cooperating guide roller assembly is preferably adjustably secured to a back surface of the display panel near a top edge of the display panel. With the guide roller assembly positioned at the top edge of the display panel, the guide roller assembly slidably engages the rail to support and selectively move the panel along the shelf sub-assembly at a visible and accessible location to customers.

The lower adjustable roller assembly is preferably secured to the portion of the shelf sub-assembly having the work space defined therein. The lower adjustable roller assembly is positioned on a shelf below the work space and adjacent a bottom edge portion of the panel, and is adapted for sliding engagement with the display panel. During sliding movement of the display panel along the shelf sub-assembly, the adjustable roller assembly supports the panel in a position away from the shelf sub-assembly. The adjustable roller assembly may be extended or contracted to change the angle and position of the panel with respect to the shelf sub-assembly.

By providing an adjustable lower roller assembly, the sliding display panel may b adapted for use with any number of shelf sub-assembly configurations. When the adjustable roller assembly is contracted, the bottom edge of the panel is positioned in early vertical alignment with the top edge of the panel. When the adjustable roller assembly is extended, the bottom edge of the panel is moved away from the shelf sub-assembly. Movement of the panel away from the shelf sub-assembly pivots the display panel about the cooperating guide roller assembly. The lower adjustable roller assembly may thus be extended or contracted as necessary to avoid interference between the display panel and any merchandise supported in the display space, or equipment in the work space, during sliding movement of the display panel along the shelf sub-assembly.

A display assembly constructed in accordance with the present invention provides an improved and more efficient display assembly to make additional display shelf space available in a retail paint store. By combining the spaced formerly required for a work station and a display panel into a single space with a sliding display panel covering the work station, the display assembly of the present invention increases display space available for displaying merchandise for sale.

Other features and advantages of the present invention will be become apparent from the following detailed description of the preferred embodiment made with reference to the accompanying drawings.

DETAILED DESCRIPTION OF THE PRESENT INVENTION

Figure 1:
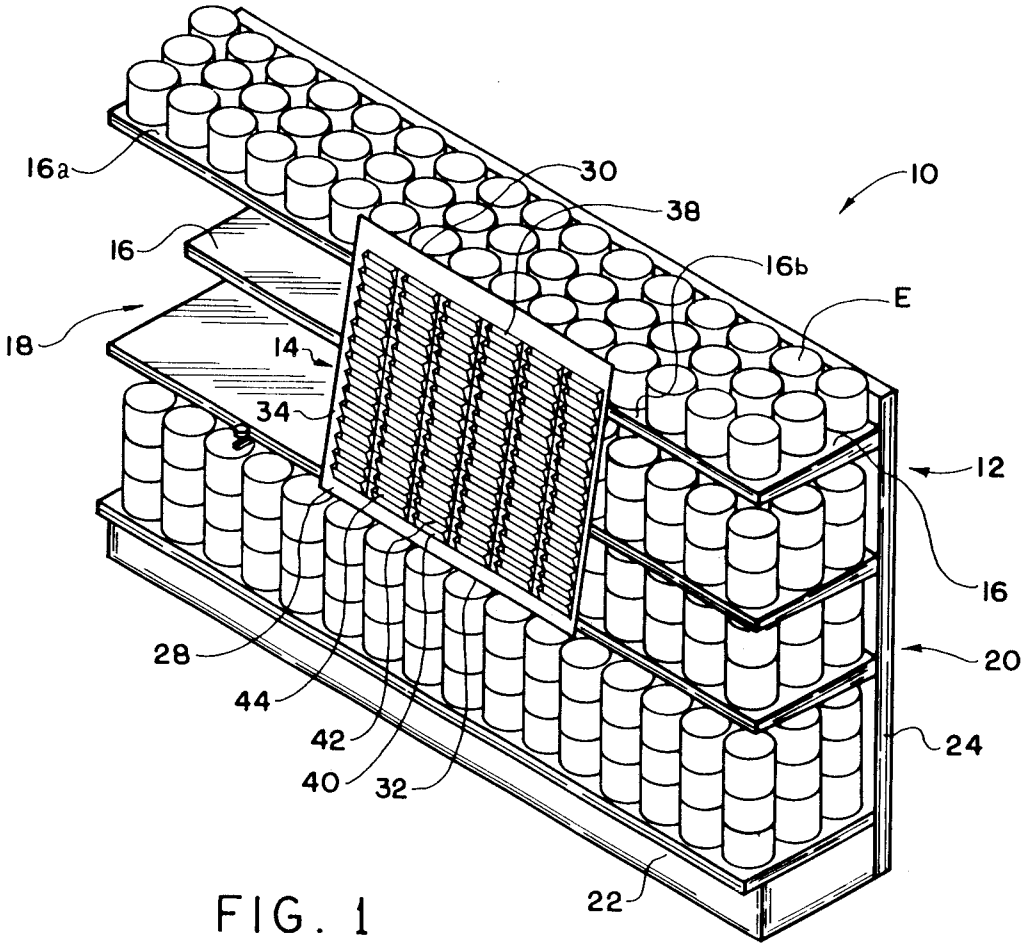
FIG. 1 is a perspective view of a display assembly constructed in accordance with the present invention.
Figure 2:
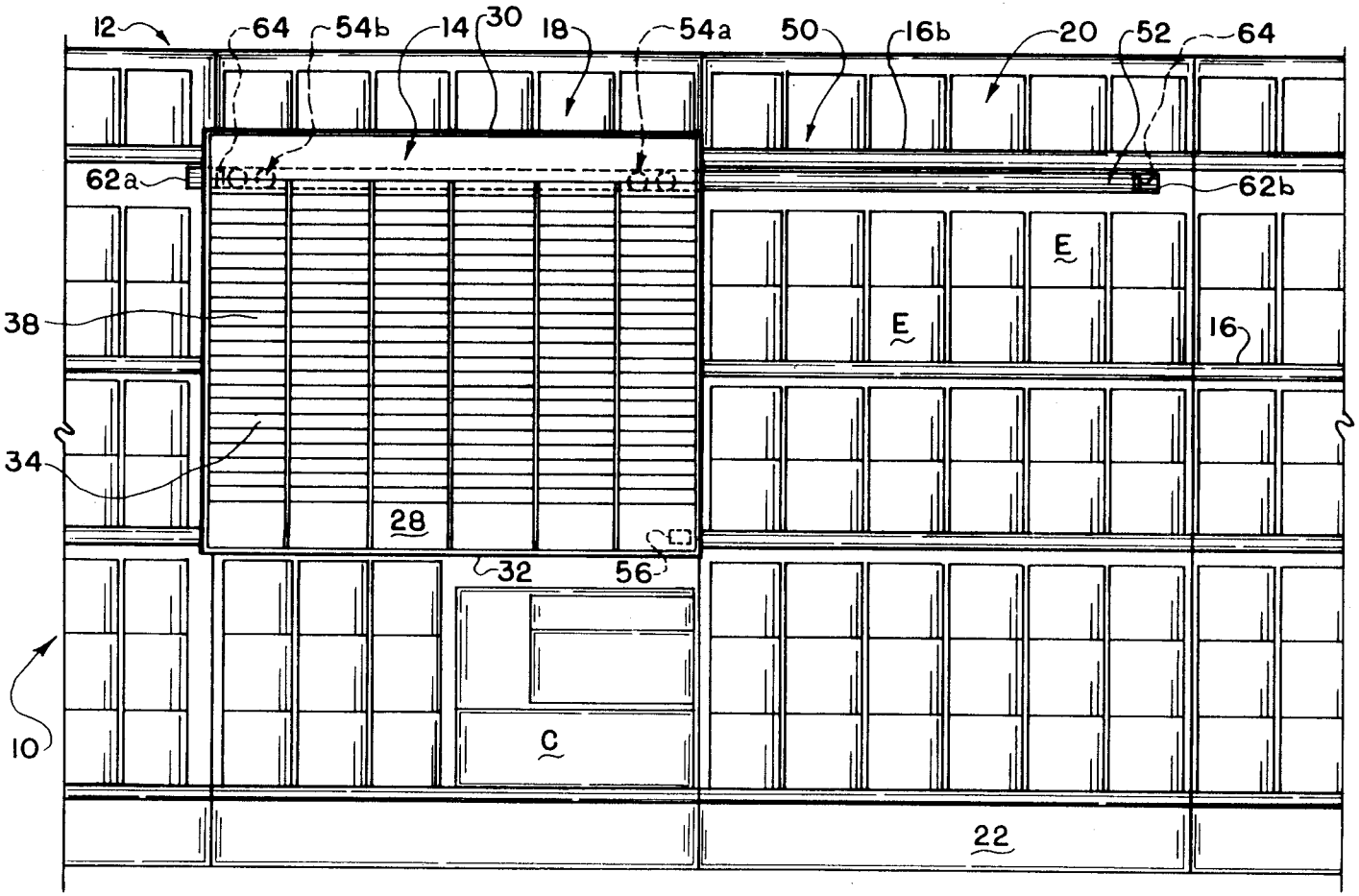
FIG. 2 is a front elevational view of the display assembly constructed in accordance with the present invention with the display panel in its closed position to cover the work space.
Figure 3:
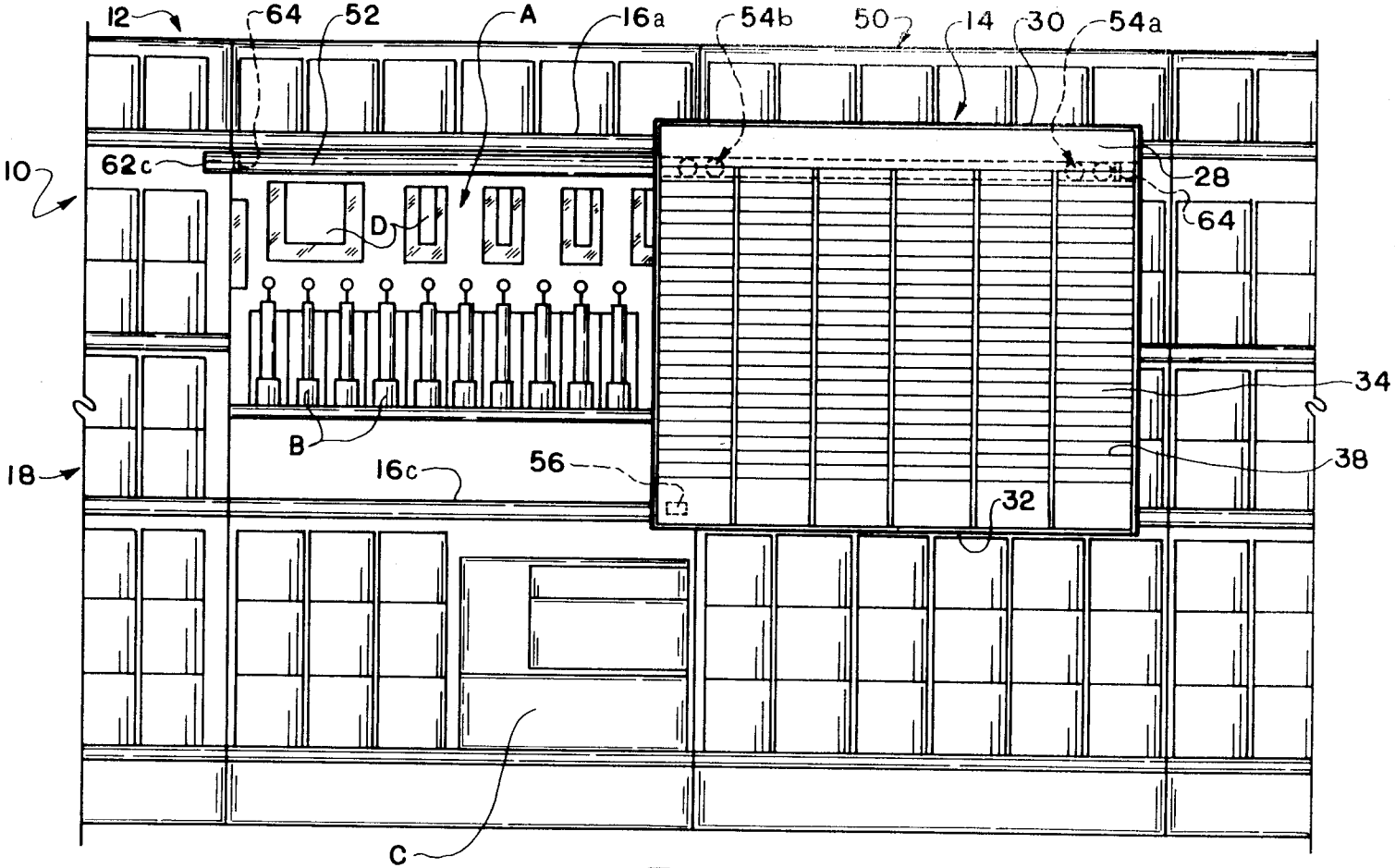
FIG. 3 is a front elevational view of the display assembly of FIG. 2 with the display panel slid to its open position to provide access to the work space while partially covering the display space.

A display assembly, indicated generally at 10, constructed in accordance with the present invention is illustrated in FIGS. 1–3 of the drawings. The display assembly 10 comprises a shelf sub-assembly 12, a display panel 14, and a sliding mechanism 50 movably supporting the display panel 14 on the shelf sub-assembly 12 for selective, reciprocal sliding movement of the display panel relative to the shelf sub-assembly to selectively cover portions of the shelf sub-assembly.

Figure 4:
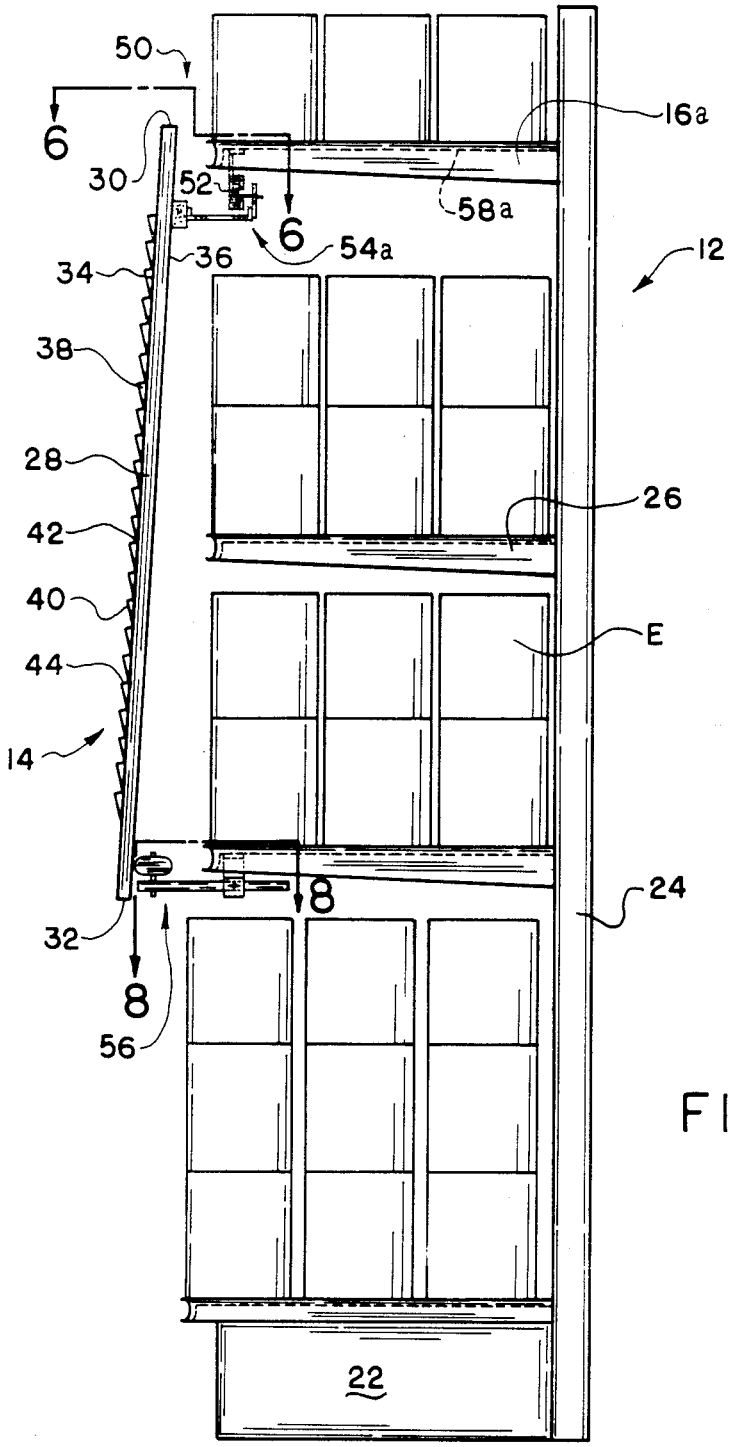
FIG. 4 is a side view of the display assembly of FIG. 3 with the lower roller assembly contracted.
Figure 5:
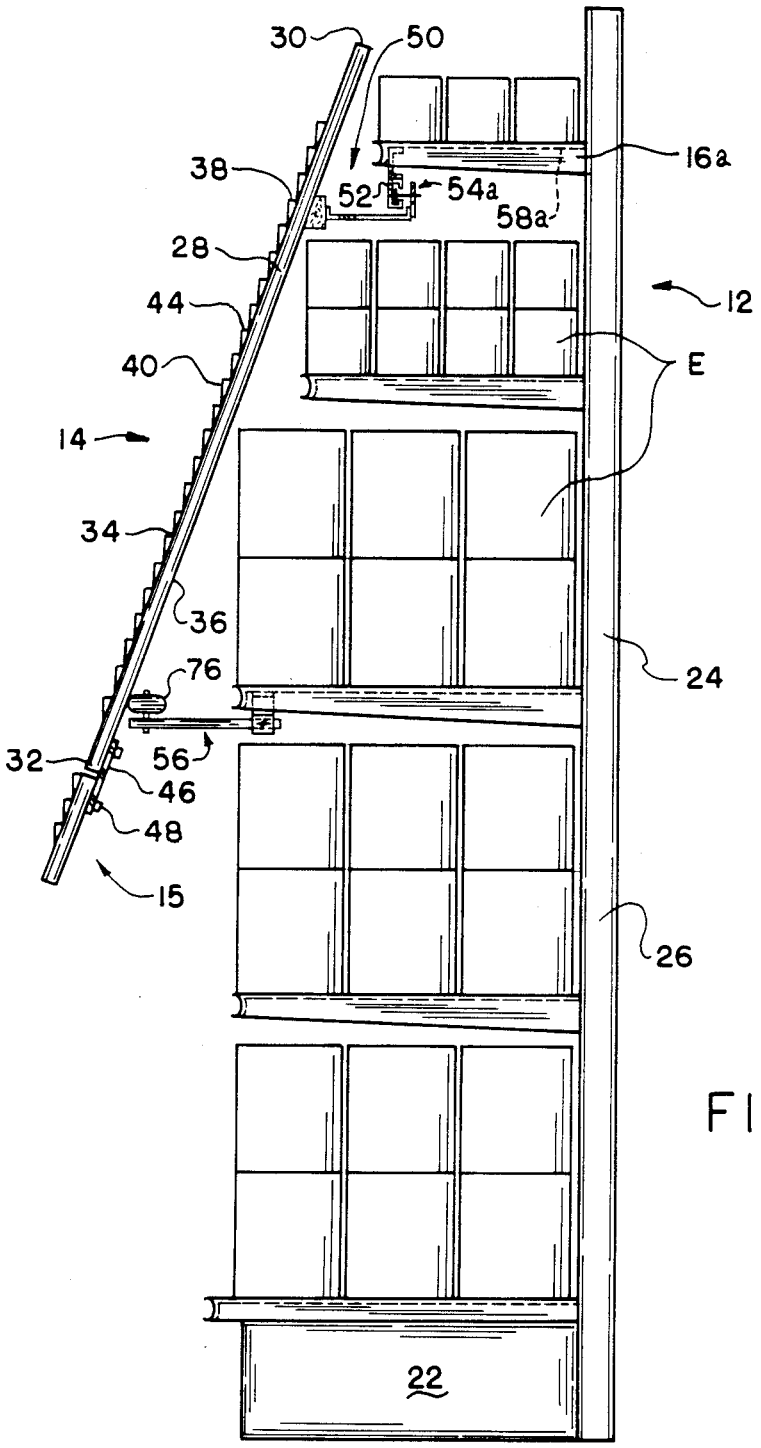
FIG. 5 is a side view of the display assembly of FIG. 3 showing the lower roller assembly extended to provide clearance for sliding movement of the display panel along a stepped display.
Figure 6:
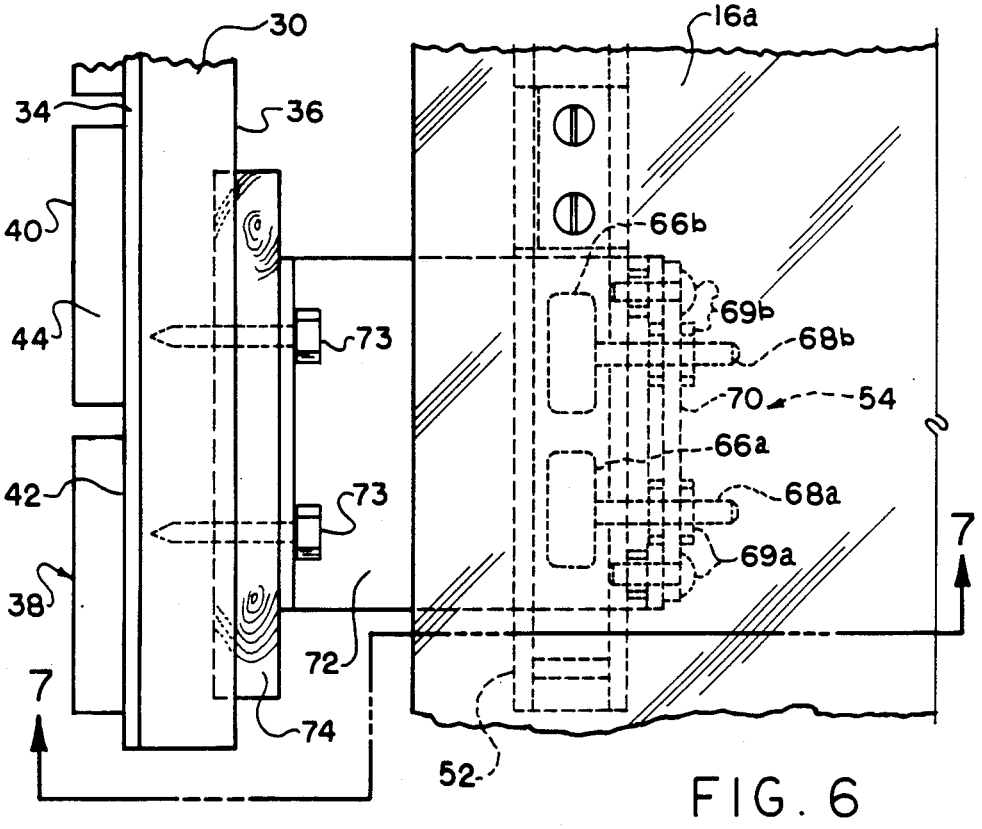
FIG. 6 is a partial top view of certain portions of the top slide connection of the display panel to the shelf sub-assembly, as taken along the line 6—6 of FIG. 4.

The shelf sub-assembly 12 is of a conventional design and may be of any suitable construction. As illustrated in FIGS. 1–5, the shelf sub-assembly includes a plurality of horizontal shelves 16 which define a work or storage space or compartment 18 and a display space 20. The shelf sub-assembly further includes a base 22 and a vertically extending mounting board or peg-board 24. The shelves 16 are secured to the mounting board 24 by conventional brackets 26. As illustrated in FIGS. 4 and 5, the shelves 16 may be secured to the mounting board 24 in a number of different configurations.

In the embodiment of the display assembly shown in FIG. 4, the shelves 16 are of equal width and spaced to accommodate merchandise of substantially the same size. In the display assembly embodiment of FIG. 5, the shelves 16 are stepped, or of different width dimensions, and spaced to accommodate merchandise of varying different sizes. The shelf sub-assemblies illustrated in FIGS. 4 and 5 are both commercially available shelf designs, and the display assembly 10 of the present invention may be readily adapted for use with these or other conventional designs not illustrated.

The shelf sub-assembly 12 illustrated in FIGS. 2 and 3, may include an area designated as a work space or may include a discontinuous shelf 16 to define a discrete work space or compartment 18. The work space shown may support equipment A required for tinting paint purchased by customers from retail paint stores, however, other uses of the space 18 may be made. The illustrated tinting equipment A is operated by store employees, and includes pigment dispensers B, a mixing and/or weighing device C, and additional containers D secured to the mounting board 24 for displaying additional merchandise or supporting additional equipment needed during the paint tinting process. The work space 18 is positioned on the shelf sub-assembly such that the tinting equipment A is easily accessible and visible by employees operating the tinting equipment A.

As further illustrated in FIGS. 2 and 3, a display space 20 for displaying merchandise is formed in the shelf sub-assembly 12 laterally adjacent the work space 18. The display space 20 is defined by shelves 16 conventionally mounted on the mounting board 24 for supporting merchandise for sale, such as paint cans E. The work and display spaces 18, 20, illustrated may be arranged so that the work space 18 is on either side of or in the middle of the display space 20.

In the illustrated and preferred embodiment, the display panel 14 is movably secured to the shelf-subassembly 12 for reciprocal sliding movement relative thereto to selectively cover or open the work space 18. By selectively covering the work space, a dual use is made at the work space 18 by supporting the equipment A and displaying sample materials, not illustrated. In the paint store environment it is often advantageous to cover tinting equipment which has become unattractive through use.

The display panel 14 is comprised of a rectangular panel member 28 having top and bottom edge portions 30, 32, respectively, a front display surface 34 and an opposing back mounting surface 36. The display panel may be manufactured of any conventional and suitable materials, for example, as a molded plastic module or a wood ply-board panel. Further, other arrangements of the one or more display panels, not illustrated, may also be used. Dual display panels, for example, could be used to cover a larger sized work or storage space. Such dual display panels could be configured to slide away from one another; each covering a display space adjacent the central work space.

The display surface 34 includes discrete compartments 38 for supporting the sample paint color cards used in retail paint stores, or other samples or merchandise. The compartments 38 may be formed in or mounted on the display surface 34 by any suitable construction. The compartments may be individually formed and attached to the display surface, or formed as a molded plastic module together with the panel member 28. As illustrated in FIGS. 1, 4 and 5 the compartments include a front wall 40, a back wall 42 formed by the board-like member 28, and an open top portion 44 for receiving the sample paint color cards.

As further illustrated in the embodiment of FIG. 5, an additional smaller display panel 15 may be added to the bottom edge of the display panel 14 to support additional sample paint color cards. The additional display panel 15 may be used, for example, by a retail paint store having a larger selection of paint colors available for customer selection. As illustrated, the additional display panel is secured to the bottom edge portion 32 of the display panel 14 by a support bracket 46 using conventional fasteners 48.

The sliding mechanism or structure 50 for movably supporting the display panel 14 to selectively cover or open the work space 18, is illustrated in FIGS. 4–10. The sliding structure 50 comprises an upper horizontal elongate rail 52, cooperating first and second guide roller assemblies 54a, 54b and a lower adjustable roller assembly 56.

The elongate rail is secured to horizontally aligned shelves 16a, 16b, of the adjacent work and display spaces 18, 20 of the shelf sub-assembly. As illustrated in the embodiments of FIGS. 4 and 5, the rail is secured to aligned shelves positioned above the work space 18. By securing the rail to aligned shelves 16a, 16b above the work space 18, the display panel 14 is supported on the sliding structure 50 approximately at eye level and within reach of customers obtaining sample paint color cards. The tinting equipment A is thus also located for easy access by employees.

Figure 7:
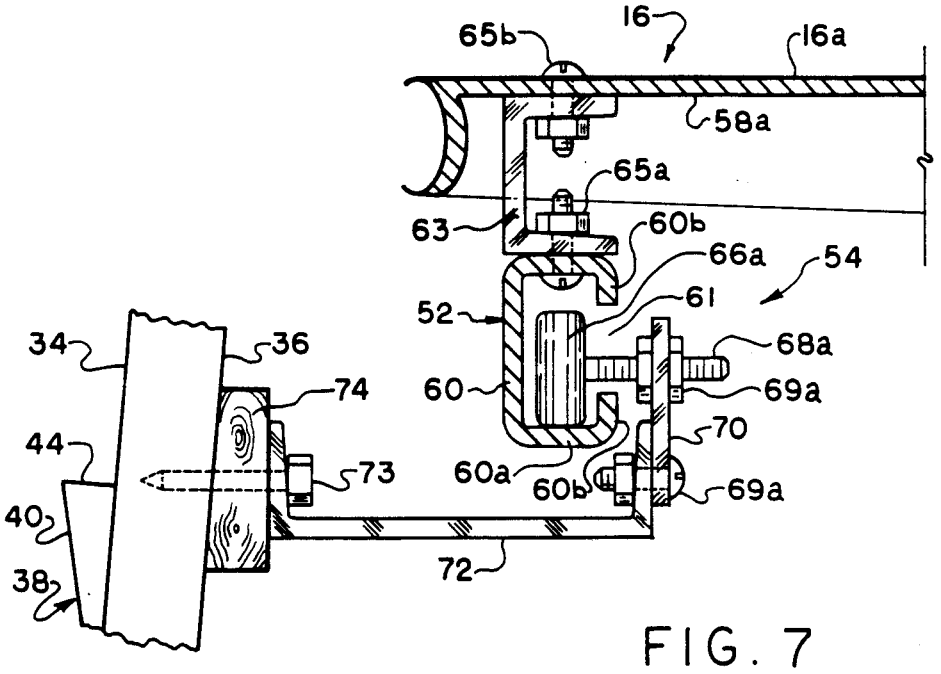
FIG. 7 is a side view of certain portions of the top slide connection of the present invention, as taken along the plane 7—7 of FIG. 6.

As shown in FIG. 7, the rail 52 comprises a body indicated generally at 60, having a generally C-shaped cross-sectional configuration with an opening 61, and opposite work space and display ends 62a, 62b. The rail illustrated in FIGS. 2 and 3, extends along the adjacent aligned shelves 16a, 16b such that the work end 62a of the rail is positioned outside the work space 18, and the display space end 62b is positioned inside the display space 20. By extending the rail as illustrated, the display panel 14 is capable of sliding movement between a position covering the work space 20, as in FIG. 2, and a position uncovering the work space, as in FIG. 3. Stops 64 are provided adjacent the rail work and display space ends 62a, 62b, for engagement with guide roller assemblies 54a and 54b respectively, to limit movement of the display panel 14.

The rail may be manufactured of any conventional and suitable materials, such as aluminum or plastic materials, and is secured to the aligned shelves 16a, 16b by any conventional and suitable techniques. In the illustrated embodiment, a mounting bracket 63 is secured to the rail 52 by conventional fasteners 65a. The mounting bracket is in turn secured to bottom surfaces 58a, 58b of the aligned shelves 16a, 16b by similar conventional fasteners 65b at the opposite ends 62a, 62b of the rail.

The first and second spaced pairs of guide roller assemblies 54a, 54b are adapted for cooperating sliding engagement within the rail body 60. As shown in phantom in FIGS. 2 and 3, the guide roller assemblies are positioned one at each upper corner of the display panel 14.

As the guide roller assemblies 54a, 54b, are substantially identical in construction, the description of the roller assemblies is provided only with respect to one of the cooperating guide roller assemblies, 54a. The guide roller assembly 54a, illustrated in FIGS. 6 and 7, includes dual roller members 66a, 66b substantially positioned within the C-shaped rail body, and engages the rail body along a bottom web portion 60a thereof. The roller members are retained within the body by flanges 60b of the rail body and are provided with sufficient clearance to enable pivotal movement of the roller members 66a, 66b within the rail body 60. The dual roller members 66a, 66b are rotatable about their respective axles 68a, 68b. The axles extend through the opening 61 in the rail body, and are connected by conventional fasteners 69a, 69b, to a generally vertically extending extension member 70 and a generally horizontally extending roller member mounting bracket 72. The mounting bracket 72 is secured by conventional fasteners 73 to the back surface of the display panel via a spacer block 74.

The roller members 66a, 66b are adapted for pivoting movement, transverse with respect to the axles 68a, 68b, within the rail body 60, upon movement of the display panel away from the shelf sub-assembly using the lower adjustable roller assembly 56. One roller member, 66a or 66b, of each of the spaced roller assemblies 54a, 54b is oriented nearest the work or display ends 62a, 62b of the rail 52, and further adapted for engagement with an associated stop 64, upon movement of the display panel 14 to the covered or uncovered positions shown in FIGS. 2 or 3.

The lower adjustable roller assembly 56 is adapted for sliding engagement along the back mounting surface 36 adjacent a bottom edge portion 32 of the display panel 14. The adjustable lower roller assembly is secured to a shelf 16c spaced from the aligned shelf 16a. As shown in phantom in FIGS 2 and 3, the adjustable roller assembly 56 is positioned within the work space 18 to ensure continuous engagement with the display panel 14 when the display panel is moved between positions covering and uncovering the work space 18.

Figure 10:
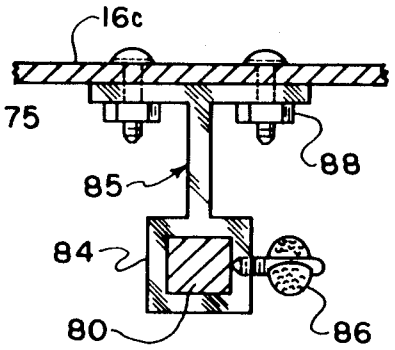
FIG. 10 is a cross-sectional view of the structure for securing the lower roller assembly in its selected position of extension, as taken along the plane 10—10 of FIG. 9.
Figure 8:
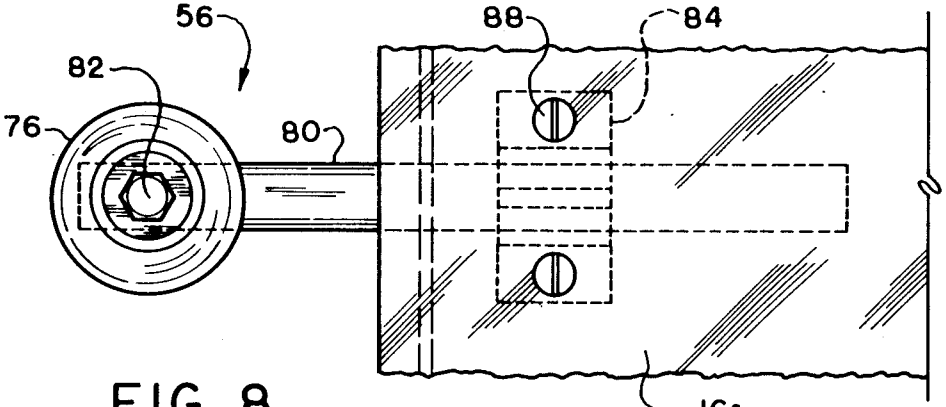
FIG. 8 is a partial top view of certain portions of the lower roller assembly for the display panel slide structure assembly of the present invention, as taken along the line 8—8 of FIG. 4.
Figure 9:
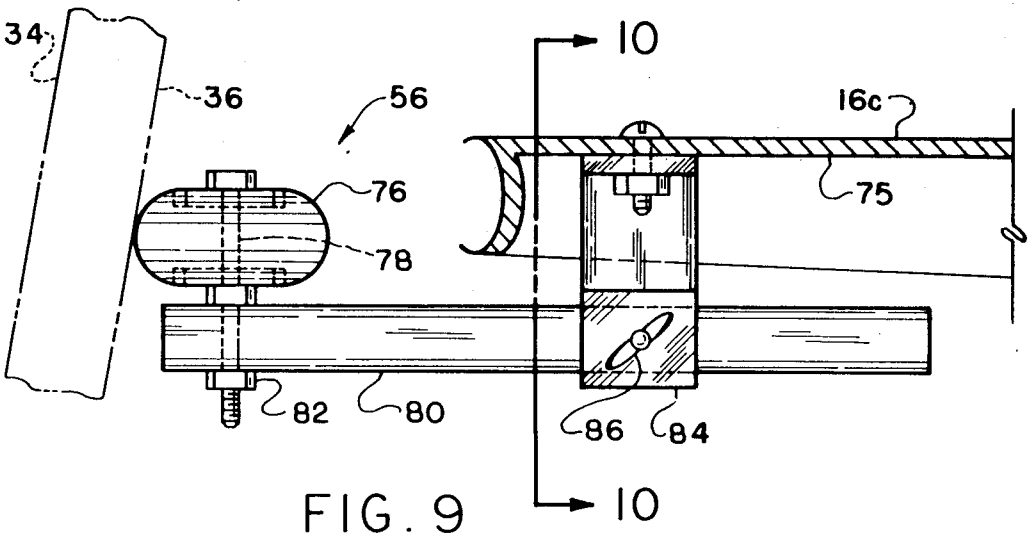
FIG. 9 is a side view of the lower roller assembly, as taken along the plant 9—9 in FIG. 8.

The adjustable lower roller assembly 56, as best illustrated in FIGS 8–10, includes a roller member 76 engagable with the back mounting surface 36 of the display panel 14. The roller member 76 is rotatable about an axle 78 secured to an adjustable extension arm 80 by a conventional fastener 82. The extension arm 80 is adjustably captured within a sleeve 84 on locking bracket 85. As shown in FIG. 10, the extension arm 80 is selectively locked at a desired position to the sleeve 84 by a conventional locking nut 86. The locking bracket 85 includes a web 86 secured to a bottom surface 75 of the shelf 16c by conventional fasteners 88.

The extension arm 80 is adapted for selective sliding movement within the locking bracket between extended and contracted positions. Upon movement and locking of the extension arm 80 in a contracted position, the display panel 14 is positioned nearly vertical with respect to the shelf sub-assembly 12 as in FIG. 4. Movement and locking of the extension arm 80 to an extended position spaces the bottom edge portion 32 of the display panel 14 away from the shelf sub-assembly in an angled position illustrated in FIG. 5. Using the adjustable lower roller assembly 56, the display panel 14 is adapted for use with shelf sub-assemblies 12, work space equipment A and display merchandise E having variable dimensions, since interference between the display panel 14 and shelf sub-assembly 12 is avoided.

The elements of the sliding structure 50 described in detail above, may be manufactured of any conventional and suitable materials. Further, the elements of the sliding structure 50 may be arranged in any number of configurations, not illustrated. The rail 52 could, for example, be secured to the display panel 14, and the cooperating guide roller assemblies 54a, 54b secured to the shelf sub-assembly 12. The elements of the sliding structure should be low is cost, light in weight, easily assembled and easily adaptable for modification of existing shelf sub-assemblies in retail paint stores. By providing the present invention with light weight, adjustable elements, the parts necessary to modify existing shelf sub-assemblies may be readily delivered to retail paint stores. Once at the store, store employees may easily mount and adjust the display panel 14, with or without the additional display panel 15, due to the adjustability of the sliding structure 50 secured to the shelf sub-assembly 12.

The present invention thus provides a low cost display assembly which may be easily shipped to retail paint stores and readily adapted to a variety of existing shelf conditions. The invention combines two prior uses of valuable display space which were unrelated to the sale of merchandise, into a single use of such space. At the same time, the invention covers potentially unsightly employee work stations, when they are not is use, with an attractive display of sample materials which are readily visible and accessible to customers.

While a preferred embodiment of the invention has been disclosed in detail, along with certain alternative constructions and arrangements, the present invention is not to be considered limited to the precise constructions disclosed herein. Various adaptations, modifications and uses of the invention may occur to those skilled in the art to which the invention relates, and the intention is to cover all such adaptations, modifications and uses falling within the spirit and scope of the appended claims.

I claim:

1. A display assembly for sample materials, merchandise or the like, said display assembly comprising, a shelf sub-assembly having a plurality of shelves defining a work space and a display space, a panel movably supported directly on said shelf sub-assembly and having compartments therein for displaying sample materials, merchandise or the like, and means for movably supporting the panel directly on said shelf sub-assembly, said means comprising a rail secured to one of said shelf sub-assembly or panel, and a cooperating first roller means secured to the other of said shelf sub-assembly or panel for movable engagement along said rail, whereby said panel may slide relative to said shelf sub-assembly, to selectively cover or open the work space of said shelf sub-assembly.

2. The display assembly of claim 1 wherein said means for movably supporting the panel further comprises a second roller means secured to said shelf sub-assembly for slidable engagement with said panel.

3. The display assembly of claim 2 wherein said second roller means is adjustably secured to a portion of the shelf sub-assembly adjacent a bottom edge of said panel, and is adapted to be contracted or extended for adjusting the angle of said panel with respect to the shelf sub-assembly.

4. A display assembly for supporting sample materials, merchandise or the like, said display assembly comprising, a shelf sub-assembly having a plurality of shelves defining a work space and a display space, wherein said display space is formed by shelves for supporting merchandise thereon, a panel having upper and lower edge portions, and a display surface spaced between said edge portions with compartments formed thereon for supporting and displaying sample materials, merchandise or the like, and means for movably supporting the panel on said shelf sub-assembly comprising an elongate rail secured to one of said shelf-sub-assembly or panel, a cooperating guide roller means secured to the other of said shelf sub-assembly or panel for rolling engagement with said rail for selectively sliding the panel relative the shelf sub-assembly to cover or open said work space, and an adjustable roller assembly secured to one of said panel or shelf sub-assembly on or adjacent a bottom edge of said panel, so that the adjustable roller assembly may be contracted or extended for adjusting the angle of said panel with respect to the rail and cooperating guide roller means.

5. The display assembly of claim 4 wherein said elongate rail is secured to the shelf sub-assembly above the work space and extends for substantially the width of the work and display spaces, and said rail including a body having a C-shaped, cross-sectional configuration receiving the cooperating guide roller means therein for rolling engagement along the body to slide the panel relative to the shelf sub-assembly.

6. The display assembly of claim 5 wherein the cooperating guide roller means comprises first and second roller members secured on the upper edge portion of the panel, said rollers being slidable within said rail body, and pivotable within said rail body upon increasing or decreasing adjustment of the angle of said panel with respect to said shelf sub-assembly by contraction or extension of said adjustable roller assembly.

7. A movable display panel supported on a back mounting surface, directly on a retail store shelf assembly, said display panel comprising a rectangular panel having upper and lower edge portions, a front display surface between said edge portions having a plurality of compartment thereon, said panel slidably supported on a shelf of the shelf assembly to cover or uncover selective portions of the shelf assembly by a sliding support structure adapted for engagement with said back mounting surface and shelf assembly.

8. The movable display panel of claim 7 wherein the sliding support structure comprises a rail and first and second roller means, said first roller means secured to an upper edge portion of said panel on said back mounting surface for slidable engagement with said rail secured to a shelf of a shelf assembly, said second roller means secured to a shelf of a shelf assembly adjacent a bottom edge portion of said panel for engagement with a lower edge portion of said panel on said back mounting surface, said second roller means including an adjustable extension arm movable between contracted and extended positions for selectively adjusting said bottom edge portion of said panel with respect to a shelf assembly.

9. The display panel of claim 8 wherein said rail is an elongate member extending for at least approximately twice the width of said panel, said rail being secured to a shelf assembly at approximately eye level to receive said first roller means to slidably support said panel along said rail at approximately eye level selectively covering or uncovering portions of a shelf assembly.

10. A method of displaying sample materials, merchandise or the like, comprising the steps of:

providing a shelf sub-assembly having a plurality of shelves defining a work space and a display space;

providing a display panel having compartments thereon;

securing said display panel directly to said shelf sub-assembly by a rail secured to either said panel or said shelf sub-assembly and a cooperating guide roller means secured directly to the other of said panel or shelf sub-assembly;

displaying sample materials, merchandise or the like on said display panel; and moving said display panel along the rail on the cooperating guide roller means to selectively cover or uncover said work space.

11. The method as set forth in claim 10 further comprising the steps of providing an adjustable roller assembly adapted for supporting the display panel along a bottom edge thereof, and adjusting said adjustable roller assembly by extending or contracting the roller assembly to selectively angle the panel with respect to the shelf sub-assembly depending on the configuration of said shelf sub-assembly or items displayed thereon.

12. The display assembly of claim 1 wherein said rail for movably supporting the panel on the shelf sub-assembly is secured to a shelf of said shelf sub-assembly, and the first roller means is secured to said panel for movably engagement therebetween along said rail.

13. The movable display panel of claim 7 wherein said display panel is slidably supported on a shelf of a shelf assembly.

* * * * *